United States Patent [19]

Lee

[11] 4,122,861

[45] Oct. 31, 1978

[54] PUMP SUPPORT AND FLUID DEFLECTOR ASSEMBLY FOR PARTS WASHING MACHINES

[75] Inventor: Edward Lee, Winnipeg, Canada

[73] Assignee: Solv-X Inventions Ltd., Winnipeg, Canada

[21] Appl. No.: 810,488

[22] Filed: Jun. 27, 1977

[51] Int. Cl.[2] ..... B08B 3/02

[52] U.S. Cl. ..... 134/109; 134/182; 134/191; 210/167; 415/121 G

[58] Field of Search ..... 134/104, 109–111, 134/115 R, 115 G, 10, 182, 191, 198; 210/167, 169; 415/121 G

[56] References Cited

U.S. PATENT DOCUMENTS

| | | | |
|---|---|---|---|
| 3,522,814 | 8/1970 | Olson | 134/111 |
| 3,890,988 | 6/1975 | Lee | 134/111 |
| 3,921,653 | 11/1975 | Ducharme | 134/111 X |

*Primary Examiner*—Robert L. Bleutge
*Attorney, Agent, or Firm*—Stanley G. Ade

[57] ABSTRACT

A truncated cone shaped pump support and fluid deflector is provided with a plurality of intake apertures in the wall thereof and the pump is supported in the wall below the upper side of the sloping wall so that the intake is uppermost and situated above the intake apertures. This maintains the pump and motor submersed in solvent at all times for cooling purposes and also provides self-priming characteristics to the pump. If the pump is switched on for too long a period, most of the fluid will be pumped to the sink of the parts washing machine thus starving the pump which, if fully exposed, can overheat and become damaged. Furthermore, with conventional pumps, if starved of fluid, air locks often occur which prevents the pump from operating correctly once liquid or fluid is restored thereto.

8 Claims, 3 Drawing Figures

FIG. 3
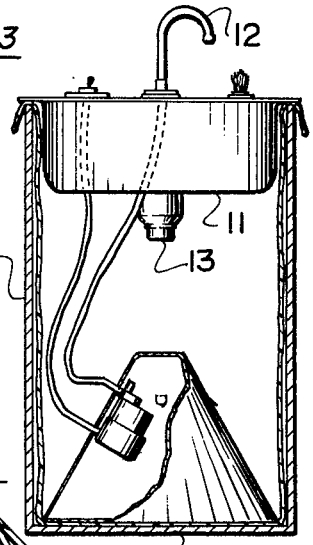
FIG. 1
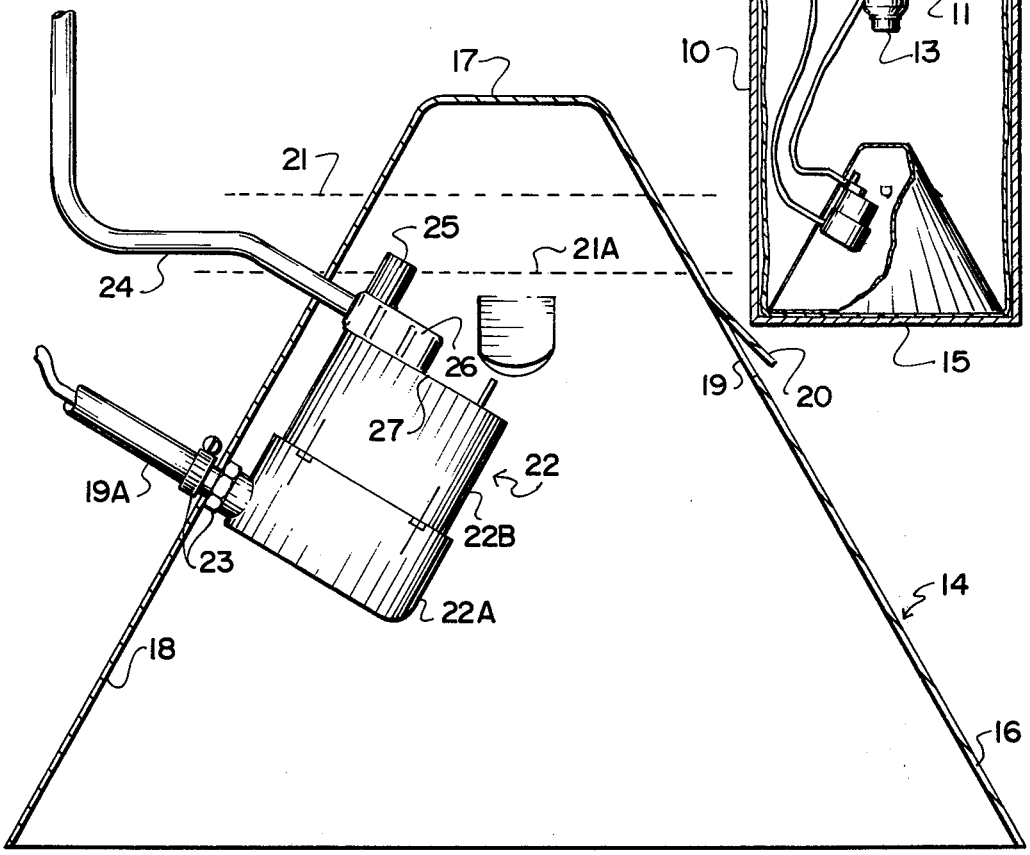
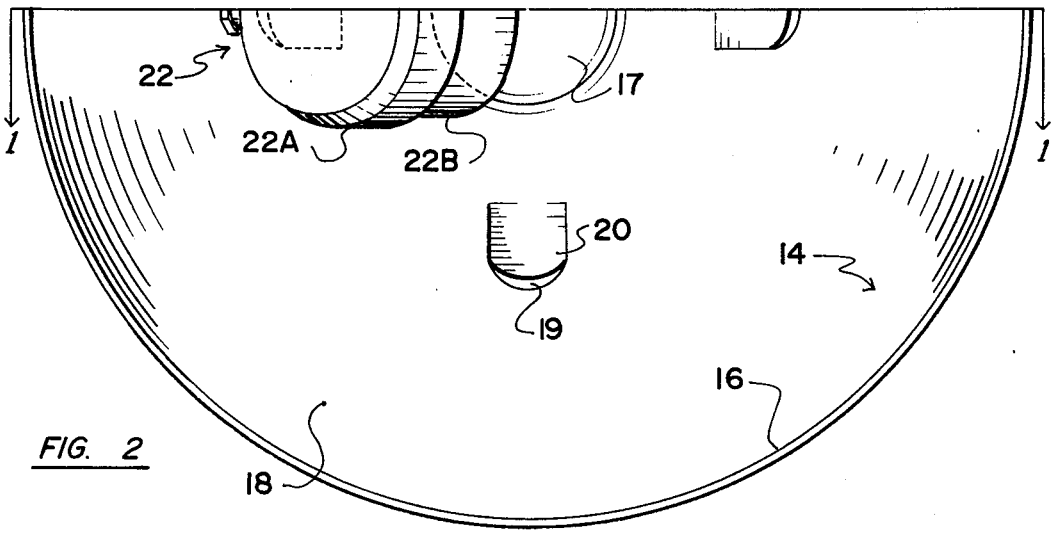
FIG. 2

PUMP SUPPORT AND FLUID DEFLECTOR ASSEMBLY FOR PARTS WASHING MACHINES

BACKGROUND OF THE INVENTION

This invention relates to new and useful improvements in parts washing machines such as those illustrated in U.S. Pat. No. 3,890,988.

This patent illustrates a parts washing machine which includes a cone shaped primary separator with a pump and motor supported at the apex thereof immediately below the drain from the sink. The secondary intake consists of a tube or conduit extending downwardly through the apex of the support and into the fluid or solvent contained within the tank or container.

Under normal circumstances, this construction operates adequately but if, for example, the pump is left on inadvertently, the fluid level within the container often drops below the intake of the pump inasmuch as the drain cannot return the fluid fast enough to maintain the fluid level.

When this occurs, the pump continues to operate without pumping fluid and overheating can occur. Furthermore, air can be drawn into the pump and an air lock may occur so that even if the pump is switched off and the fluid level is returned to normal, the air lock will often prevent the pump from drawing fluid due to the length of the intake which is occasioned by the design of the primary separator and support cone.

Even although thermal overload means were provided, occasionally the pump motor would burn out due to this overheating and fluid starvation.

SUMMARY OF THE INVENTION

The present invention overcomes all of these disadvantages by providing a sloping wall type combination pump and motor support and primary separator component situated within the container and having the pump and motor component supported internally on the sloping wall with the pump intake uppermost.

The principal object of the invention is to provide a device of the character herewithin described in which the pump and motor component are supported with the intake uppermost so that the pump and motor are always submerged in fluid or solvent thus assisting in the cooling process.

Another object of the invention is to provide a device of the character herewithin described which, due to the intake facing uppermost, provides automatic priming for the pump and prevents air locks from occurring.

A still further object of the invention is to provide a device of the character herewithin described which is simple in construction, economical in manufacture and otherwise well suited to the purposes for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

FIG. 1 is a cross sectional side elevation view substantially along the line 1—1 of FIG. 2.

FIG. 2 is an underside view through 180° of FIG. 1, it being understood that the device is symmetrical about the center line shown.

FIG. 3 is a partial sectional view reduced in scale with reference to FIGS. 1 and 2, of a solvent cleaner with the device of FIGS. 1 and 2 shown in position therein.

In the drawings like characters of reference indicate corresponding parts in the different figures.

DETAILED DESCRIPTION

Proceeding therefore to describe the invention in detail, reference should first be made to FIG. 3 in which 10 illustrates a casing or reservoir having a sink 11 situated thereabove for the reception of parts for cleaning. A solvent discharge pipe 12 discharges fluid into the sink from the container or reservoir 10 and this solvent drains downwardly from the sink into the container through the centrally situated drain pipe 13, all of which is shown in the above-identified patent.

The invention illustrated in details in FIGS. 1 and 2 is collectively designated 14 and consists of a combination pump and motor support and primary separator component normally situated on the floor 15 of the solvent container or reservoir 10.

In this embodiment, this component comprises a truncated conical component 16 having an upper planar or truncated closed portion 17 and outwardly and downwardly sloping wall portion 18. This component is situated substantially centrally of the container 10 and immediately below the drain 13 so that any fluid or solvent falling from the drain, strikes the truncated upper portion 17 and is deflected downwardly and outwardly by the sloping wall portion 18, to adjacent the outer walls of the container 10. This ensures that any heavy particles contained within the contaminated solvent, are deposited by gravity around the outer base of the component 14 in a manner similar to that described in the previous mentioned patent.

Fluid or solvent intake apertures 19 are formed through the sloping wall portion 18 of the component 14 adjacent the upper end thereof and these apertures are preferably formed by striking out tabs 20 which reamin in the downwardly and outwardly inclined position illustrated thus shielding the intake apertures 18 and directing the solvent flowing down the outside of the component 14, towards the outer perimeter of the component 14.

The fluid or solvent level normally is at a level for example, illustrated by reference character 21 and a pump and motor component collectively designated 22 is secured to the inner surface of the sloping wall portion 18 by any conventional means (not illustrated). The sealed motor portion 22A is provided with a sealed electrical conduit connection 19 which extends to a source of electrical power (not illustrated) and maybe controlled by a convenient switch (not illustrated) within the parts cleaner and the combination of a nut and clamp 23 on each side of the wall of the portion 18, may assist in supporting the component 22.

The pump portion 22B is provided with a fluid discharge conduit 24 also extending through the wall portion 18 and means may be provided in conjunction with this conduit also to assist in the support of the component 22.

The pump intake 25 extends upwardly from a housing26 on the upper side 27 of the pump 22B and normally this relatively short intake 25 is situated below the normal fluid level 21.

However, if the unit is left on inadvertently, the fluid level 21 may fall to the level indicated by reference character 21A and of course, as soon as the intake 25 is exposed, the fluid level will not fall any further as obviously fluid cannot enter the intake.

This maintains the pump and motor component 22 submerged in fluid or solvent at all times so that even if it is left on inadvertently, a cooling effect is provided by this immersion within the solvent.

When the fluid level is returned to the original level 21, as for example, when the unit is switched off, then fluid or solvent flows by gravity into the intake 25 and prevents any air lock from causing the pump to become inoperative. In other words, as soon as the pump is switched on again, fluid will be pumped in the usual manner.

It will also be noted that the pump intake 25 is higher than the intake apertures 19 which is advantageous to the operation of the device.

The component 14 together with the positioning of the pump and motor component 22, also facilitates the operation of the parts cleaning device by permitting the user to close off the drain 13 in the event that he wishes to have a quantity of solvent retained within the sink 11 so that contaminated parts can be soaked in the solvent. When the drain 13 is closed off in the conventional units, too much solvent is sometimes removed from the container 10, once again causing pump starvation which even if overheating does not occur, often causes air locks which cannot be overcome merely by submerging the downwardly extending intake into the solvent.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. In a solvent type parts cleaner which includes a sink, a solvent container below said sink and drain means in said sink for draining solvent from said sink into said container; a combination pump-and-motor-support and primary separator component in said container, said component including an upper, solvent receiving portion and an outwardly and downwardly sloping wall portion to deflect solvent from said drain means, outwardly towards the wall of said container, means for solvent to enter the interior of said component from said container, said pump and motor unit including a pump intake situated above said pump and motor unit whereby said pump and motor unit remains submerged in the solvent in said container.

2. The invention according to claim 1 said pump intake being situated above said means for solvent to enter the interior of said combination pump-and-motor-support and primary separator component.

3. The invention according to claim 2 in which said means for solvent to enter the interior of said component from said container includes a plurality of openings formed through the downwardly sloping wall portion of said component spaced below said solvent receiving portion, and shielding tabs overlying said openings and including outwardly and downwardly to shed solvent flowing down the outside of said sloping wall portion.

4. The invention according to claim 3 in which said pump and motor support and primary separator component is in the form of a truncated cone, said solvent receiving portion being formed by the closed upper end of said truncated cone, said pump and motor component being secured to the sloping wall portion of said truncated cone.

5. The invention according to claim 2 in which said pump and motor support and primary separator component is in the form of a truncated cone, said solvent receiving portion being formed by the closed upper end of said truncated cone, said pump and motor component being secured to the sloping wall portion of said truncated cone.

6. The invention according to claim 1 in which said means for solvent to enter the interior of said component from said container includes a plurality of openings formed through the downwardly sloping wall portion of said component spaced below said solvent receiving portion, and shielding tabs overlying said openings and inclining outwardly and downwardly to shed solvent flowing down the outside of said sloping wall portion.

7. The invention according to claim 6 in which said pump and motor support and primary separator component is in the form of a truncated cone, said solvent receiving portion being formed by the closed upper end of said truncated cone, said pump and motor component being secured to the sloping wall portion of said truncated cone.

8. The invention according to claim 1 in which said pump and motor support and primary separator component is in the form of a truncated cone, said solvent receiving portion being formed by the closed upper end of said truncated cone, said pump and motor component being secured to the sloping wall portion of said truncated cone.

* * * * *